United States Patent [19]

Nubson et al.

[11] Patent Number: 4,688,785

[45] Date of Patent: Aug. 25, 1987

[54] EMBOSSING ASSEMBLY FOR AUTOMATIC EMBOSSING SYSTEM

[75] Inventors: Richard C. Nubson, Eden Prairie; Ronald B. Howes, Jr., Minneapolis; Glenn R. Carney, Eagan; Edward R. Gabel; Robert H. Schmidt, both of Minnetonka; Leroy E. Gerlach, Bloomington; Michael D. Polad, Mendota, all of Minn.

[73] Assignee: Data Card Corporation, Minnetonka, Minn.

[21] Appl. No.: 697,434

[22] Filed: Feb. 1, 1985

Related U.S. Application Data

[62] Division of Ser. No. 449,131, Dec. 13, 1982, abandoned.

[51] Int. Cl.[4] ..... B65H 5/02

[52] U.S. Cl. ..... 271/266; 271/270; 271/271

[58] Field of Search ..... 271/140, 233, 266, 269, 271/270, 271

[56] References Cited

U.S. PATENT DOCUMENTS

| | | | |
|---|---|---|---|
| 2,113,052 | 4/1938 | Kemp | 271/271 X |
| 2,484,905 | 10/1949 | Peyrebrune | 101/183 |
| 3,001,624 | 9/1961 | Guttel et al. | 400/134.2 |
| 3,042,175 | 7/1962 | Guttel | 400/134 |
| 3,557,692 | 1/1971 | Lee | 101/183 X |
| 3,613,571 | 10/1971 | Russell et al. | 101/40 |
| 3,774,905 | 11/1973 | Williams | 271/271 UX |
| 4,037,530 | 7/1977 | Sirvet | 101/40 |
| 4,090,703 | 5/1978 | Straube | 271/271 X |
| 4,091,910 | 5/1978 | Bolton et al. | 400/131 |

FOREIGN PATENT DOCUMENTS

| | | | |
|---|---|---|---|
| 1118804 | 12/1961 | Fed. Rep. of Germany | 400/134.2 |
| 2430292 | 1/1975 | Fed. Rep. of Germany | 400/144.2 |

*Primary Examiner*—Richard A. Schacher

*Attorney, Agent, or Firm*—Faegre & Benson

[57] ABSTRACT

An embossing module for an automatic embossing machine utilizes a pair of opposed embossing element carrying wheels driven by oscillating bail arms which directly engage the embossing punch and die elements. An electromechanical interrupter mechanically decouples motion of the bail arm from the embossing elements in the event of a failure. The printwheels are driven by separate motors utilizing separate position encoders and common servo command circuits.

4 Claims, 9 Drawing Figures

EMBOSSING ASSEMBLY FOR AUTOMATIC EMBOSSING SYSTEM

REFERENCE TO CO-PENDING APPLICATION

This application is a division of pending application Ser. No. 449,131 filed Dec. 13, 1982, abandoned as of the filing date of the present application.

DESCRIPTION

Background of the Invention

1. Field of the Invention

This invention relates to an embossing system for embossing characters on a sheet medium such as a plastic credit card.

2. State of the Prior Art

Embossing systems are in widespread use. Two such systems are shown in U.S. Pat. Nos. Re. 27,809 to Drillick and 4,088,216 to LaManna et al both of which are assigned to Data Card Corporation. Both of those systems are of substantially greater mechanical complexity and size in their embossing mechanism and may, therefore, require a relatively larger amount of maintenance and power to operate.

In the machine of U.S. Pat. No. Re. 27,809, a blank card is indexed along a card track past an array of punches and dies longitudinally arranged along the card track at a fixed height. Characters are embossed on one line of the card when the desired space is positioned adjacent a related die and punch pair on opposite sides of the card. A pair of bail arms driven in coordinated reciprocating or oscillatory movement by eccentric arms driven by an eccentric which is in turn driven by a motor-driven drive shaft provides the embossing pressure for the punch and die elements. Electromechanical interposers are utilized to couple movement of the bail arms to actuate a particular punch and die pair. A separate pair of interposers is required to be actuated and moved for each operation of a punch and die pair which results in a machine having a high degree of electromechanical complexity.

In the machine shown in U.S. Pat. No. 4,088,216 cards are supported in an X-Y access controlled positioning mechanism which places the proper portion of the card surface in alignment with a selected punch and die member mounted around the circumference of a punch and die wheel coaxially mounted on a single hub driven by a drive shaft. The angular position of the wheel selects the proper punch and die pair from the wheel. Bail arms driven by an eccentric link from a drive shaft apply the embossing pressure to the selected punch and die pair. Motion of the bail arms is converted to movement of the punch and die by actuating interposers positioned between the bail arms and the punch or die elements carried by the wheels. The interposers provide a mechanical coupling between the bail arm and the punch or die. The bail arms are indicated in the patent as necessary to allow for unobstructed rotation of the punch and die wheel while the bail arms continuously reciprocate or oscillate. The use of interposers which must be actuated and electromechanically moved on each mechanical cycle of the machine greatly increases the complexity of the machine.

In the embossing machine shown in U.S. Pat. No. 4,378,733, issued Apr. 5, 1983, a rotating cam was used to drive cam followers mounted on the bail arms. The embossing punch and dies are carried in slots positioned about the circumference of punch and die wheels mounted on a single hub and driven by a single shaft from a single power source. Electromechanical interposers again provide the mechanical coupling between the bail arm movement and the punch and die elements. In order to drive the embossing element into contact with the card the interposers are required to be actuated and moved into the interposing position in order to couple bail arm movement to the embossing elements.

While all of the systems described above are satisfactorily operable, the requirement of using electromechanical interposers between moving bail arms and the movable punch or die elements adds substantially to the mechanical complexity of the machine, thereby reducing its inherent reliability. Furthermore, the use of punch and die wheels mounted on a single shaft requires use of larger print wheels in order to provide coverage of the entire surface of the card to be embossed. Of course, the consequence of using larger print wheels is that they unavoidably have a much higher inertia and are more slowly positioned and require a substantially larger amount of power to drive them. The sensitivity to size is particularly acute because the moment of inertia of the embossing wheels increases exponentially with their radius, thus requiring an exponential increase in motor torque with a corresponding requirement on motor current.

SUMMARY OF THE INVENTION

In accordance with one aspect of this invention, there is provided a machine for utilizing a plurality of pairs of cooperative embossing elements positioned on opposite sides of the card to emboss a selected character at a desired imprint location. The machine includes a positioner for positioning the desired imprint location of a card in alignment with an embossing station in the machine. The machine utilizes first and second print wheels rotatably mounted on opposite sides of the path of the card through the machine and each wheel is constructed and arranged for carrying a plurality of cooperative embossing elements about its circumference with each of the elements slidably movable along the axis of the wheel for engaging the card. The machine also includes apparatus for rotating the first and second print wheels for positioning a selected pair of embossing elements at an embossing station and reciprocating means for engaging a selected pair of embossing elements at the embossing station and applying a selected character to the desired imprint location upon a card.

A primary object of the invention is to provide a card embossing mechanism which does not require the operation and movement of an electromechanical interposer to couple movement of a reciprocating oscillatory bail arm to a selected punch and die pair.

Another object of the invention is to provide an embossing mechanism where the embossing element carrying wheels are mounted on separate shafts to avoid interference between a common mounting hub and a card positioned between the embossing wheels thereby reducing the size of the wheel required to emboss the entire surface of a card having a particular size.

A further object of the invention is to provide an improvement to a card indexing arrangement for indexing cards along a card track by engaging an edge of the card with a projection on a continuous belt which includes a segment running parallel to the track and wherein the card can be transferred from one such belt drive to another without damaging projections on the indexing belt.

A still further object of the invention is to provide a servo control system for individual printwheels which causes them to be moved in precise synchronism by separate drive motors in response to a common command signal.

Another object of the invention is to provide an electromechanical interrupter mechanism to decouple the bail arms and print elements to prevent application of full embossing pressure to print elements in the event of failure.

Yet another object of the invention is the provision of a circuit for supplying a rate feedback signal from a position encoder transducer where the differentiation of the position signals occurs subsequent to commutation while utilizing a single differentiation circuit rather than multiple differentiation circuits as is common in the prior art.

DESCRIPTION OF THE DRAWINGS

Other objects and advantages of this invention will become apparent from the following detailed description thereof and the accompanying drawings wherein.

DESCRIPTION OF THE PREFERRED EMBODIMENT

Embossing Mechanism

Figures 1, 2:
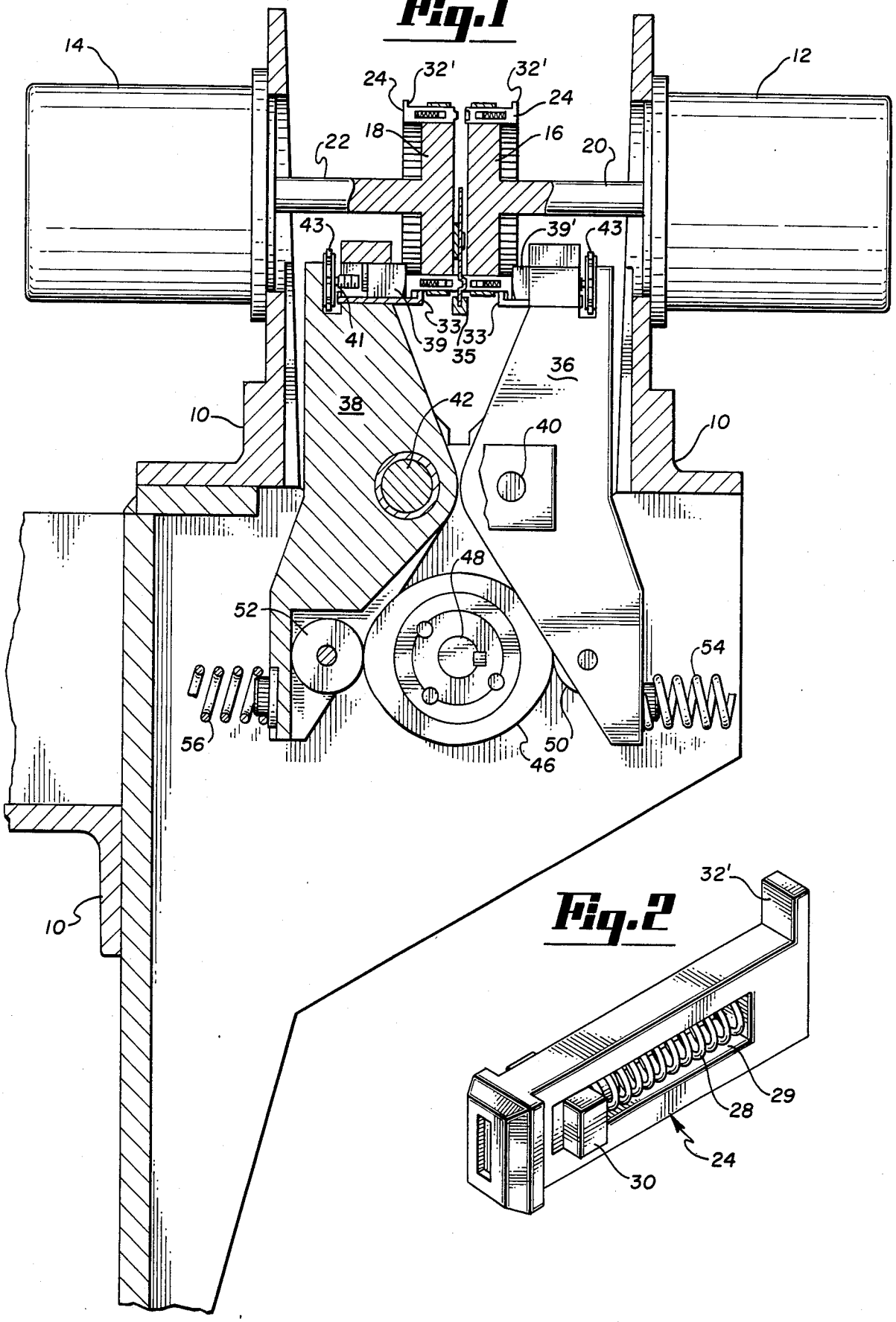
FIG. 1 is a side elevational view of the embossing mechanism according to the present invention.
FIG. 2 is a fragmentary pictorial detailed view of the construction of the type wheels shown in FIG. 1.

Referring first to FIG. 1 a typical embossing station according to the present invention is shown. In a typical machine there may be as many as six or more separate embossing stations to emboss separate lines on a plastic card being transported through the machine. Each of the embossing stations is essentially identical with only the vertical position of the card blank relative to the embossing elements being varied from module to module.

Figure 5:
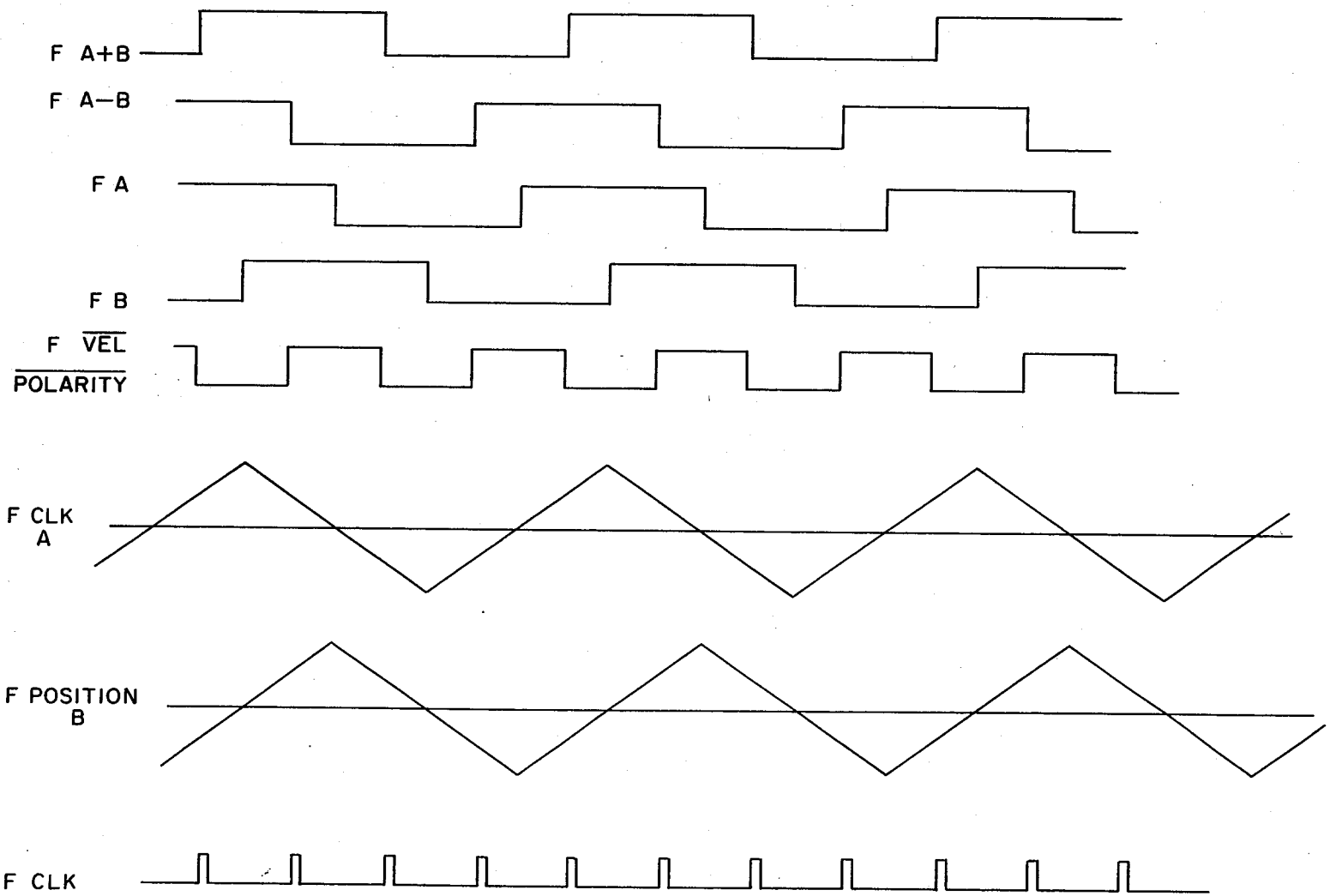
FIG. 5 is a phasing diagram showing the relationship of various control signals used in the electronic circuitry of FIGS. 4*a* and 4*b;*

In FIG. 1, the frame 10 of the embossing machine supports a pair of motors 12 and 14 which respectively drive printer embossing wheels 16 and 18. In the preferred embodiment shown the motors are DC servo motors which have modular position encoder devices mounted on one end of the motor shaft. The position encoders may be conventional optical position encoders or any other encoders which produce generally triangular output waveforms as a function of an angular shaft displacement. The F CLK and F position signals illustrated in FIG. 5 are illustrative of such waveforms which are, as can be seen, shifted 90° from each other.

Shafts 20 and 22 respectively of motors 12 or 14 are connected by an appropriate means to printer embossing wheels 16 and 18. Because the embossing wheels 16 and 18 are identical, the details of only one such structure are shown in FIG. 2. In contrast to prior art rotatable embossing apparatus, there is no connecting hub or axle between embossing wheels 16 and 18.

The printwheel 16 has a plurality of embossing elements 24 disposed in a plurality of slots 26 distributed around its circumference. Typically, one of the printwheels carries die embossing elements, while the other carries the corresponding punch embossing elements in opposing positions. One or more of the positions on each wheel is empty and must be positioned at an embossing station when no character is to be embossed. The embossing elements are maintained in a normally retracted position in the printwheels 16 or 18 by the action of individual springs 28 which are each located in a slot 29 of print element 24, as shown in FIG. 2. The shoulders of the spring retainer 30 are retained in a slot in printwheel 16 or 18 which is aligned transversely to slot 29. The force of springs 28 urges the embossing elements 24 to remain in their retracted positions and restores them to the retracted positions after the completion of each embossing operation.

The embossing operation is accomplished by forcing cooperative punch and die printing elements 24 together to engage both the front and back surfaces of a plastic card 34 as shown in FIG. 1. In FIG. 1, the embossing elements 24 at the bottom of the wheels are in the embossing position at an embossing station. Card 34 is carried in a track 35 which supports the card as it is embossed. In order to emboss a card at separate vertical lines on the card, the positioning of track 35 relative to the other embossing elements shown in FIG. 1 is varied from embossing module to embossing module in the complete embossing machine.

It will be noted from an examination of FIG. 1 that the fact that there is no shaft or hub connecting printwheels 16 and 18 allows the face of card 34 to be vertically positioned completely between the printwheels. In the prior art where there was a central hub between the punch and die carrying wheels, it was necessary to provide a radial distance between the edge of the central hub and the edge of the disc which was at least as great as the vertical height of the card.

The embossing force is applied to print elements 24 positioned at an embossing station by a pair of bail arms 36 and 38 which are pivotally mounted on bearings 40 and 42, respectively. The bail arms 36 and 38 are driven by a cam 46 mounted on a shaft 48. Cam followers 50 and 52 provide an accurate rolling friction tracking of the bail arms on the cam surface to allow an extremely large number of operations of the bail arm assembly without significant wear. Springs 54 and 56 are used to force the bail arms into engaging and tracking relation with cam 46. For each revolution of the cam, two embossing operations may be performed.

When the bail arms close to perform the embossing operation, they directly contact the print elements 24. As shown in partially cut-away form on bail arm 36, a print hammer 39 is positioned on the top of bail arm 38. The extension of print hammer 39 from bail arm 38 is controlled by a set screw 41 which is adjusted by rotating the head of the screw 43. A similar arrangement is mounted on the top of bail arm 36.

Positive withdrawal of the printing elements from the cards is assured by flanged retractors 33 which are part of the print hammer 39. Retractors 33 engage a flange 32' on print elements 24 to positively withdraw them from card 34 at the completion of the embossing cycle when the upper portions of bail arms 36 and 38 start to draw apart.

Interrupter Mechanism

Figure 6:
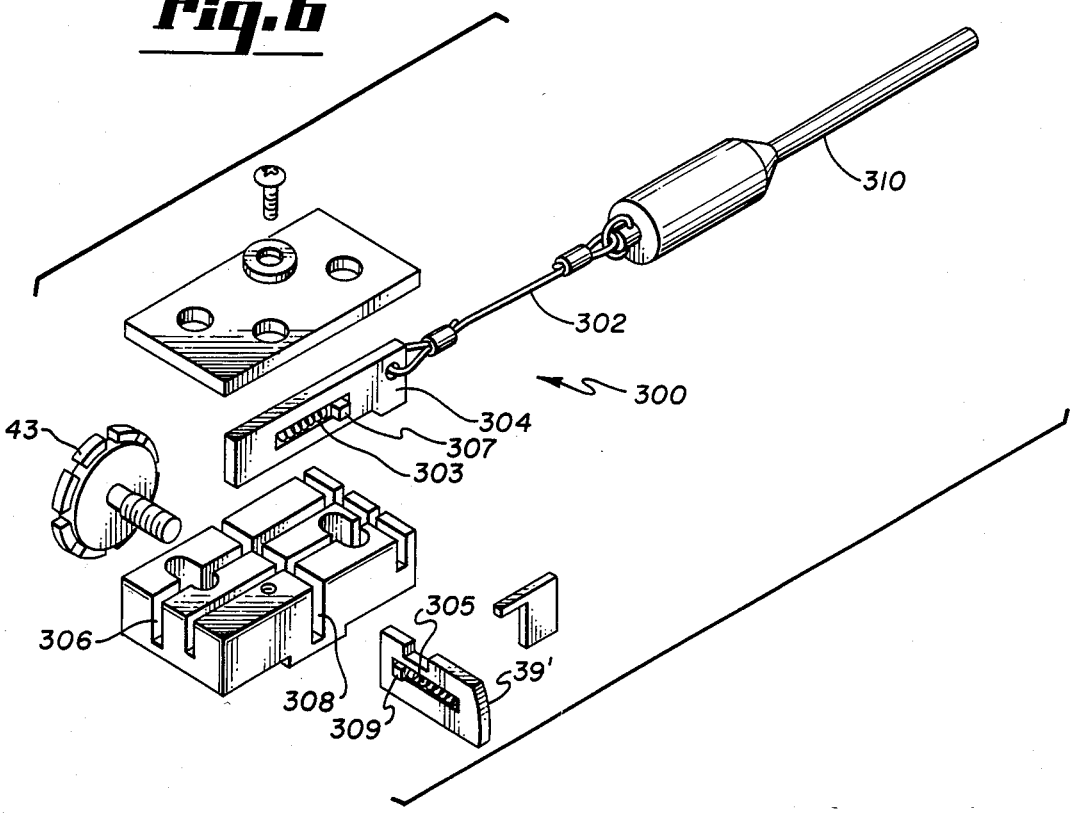
FIG. 6 is an exploded view showing the interrupter mechanism.
Figure 7:
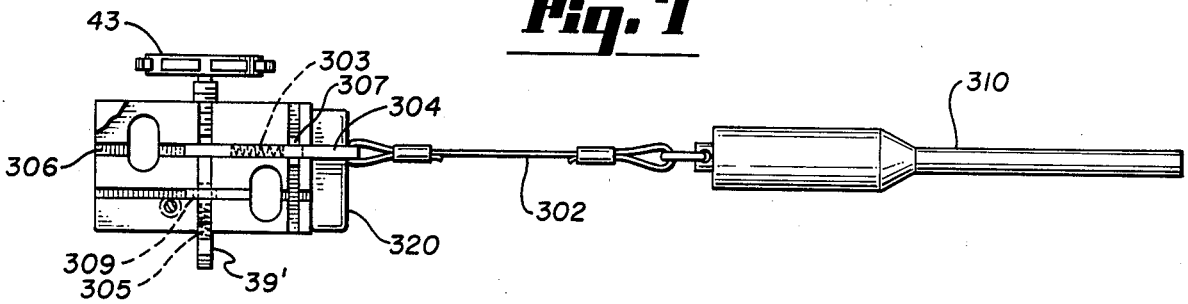
FIG. 7 is a pictorial view of the interrupter mechanism.
Figure 8:
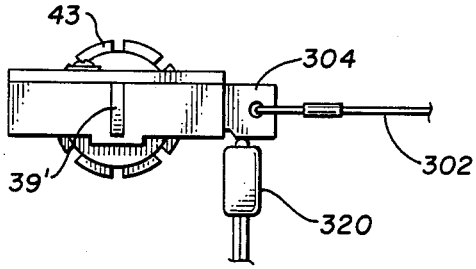
FIG. 8 shows the interrupter mechanism and sensor switch.

In order to provide positive protection for the printwheel in the event of a jam or other operating failure of the embossing machine, in the preferred embodiment, one or both of the print hammer mechanisms can be replaced by the interrupter mechanism 300 shown in FIG. 6. An interrupter may be mounted on either bail arm in place of the print hammer to prevent the application of full embossing pressure to print elements 24 in the event of a machine failure. In the event of a failure, the electrical enabling signal actuates the interrupter solenoid, causing lanyard 302 to be placed in tension to retract backing piece 304 in slot 306. When backing piece 304 is retracted, it removes the support from link 39', which then slides in slot 308 into interrupter 300 when the bail arms close and link 39' makes contact with print element 24. Print hammer link 39 is therefore no longer held in a rigid position to move print element 24 when bail arm 38 oscillates. As can be seen in FIGS. 6 and 7, the various movable links 304 and 39' in interrupter 300 each have springs 303 and 305 and retainers 307 and 309 which correspond generally to the springs and retainers used to mount the embossing elements 24 in printwheels 16 and 18. Backing piece 304 is returned to a normal position, blocking channel 308 by the restoring force of spring 303 when the force on lanyard 302 is removed. Link 39' is spring biased to its projecting position by spring 305 to permit backing piece 304 to slide back in channel 306 to block channel 308 after the solenoid pulling on lanyard 302 is released. The interrupter is therefore automatically reset after a failure as soon as the failure signal is removed from the solenoid and the bail arms are opened. Switch 320 senses whether the interrupter has been actuated.

The interrupter mechanism is distinguishable from the interposer elements in the prior art because it is required to electromechanically function only in the event of a failure. It then partially disconnects or decouples mechanical movement of the bail arms from the print elements to greatly reduce embossing pressure to avoid damage to the print elements. It is electromechanically actuated and moved only in the presence of a mechanical failure in the embossing mechanism. The failure signal which actuates a solenoid winding to pull solenoid plunger 310 which is attached to lanyard 302 can be generated by known circuitry in the presence of machine failures.

Figure 3:
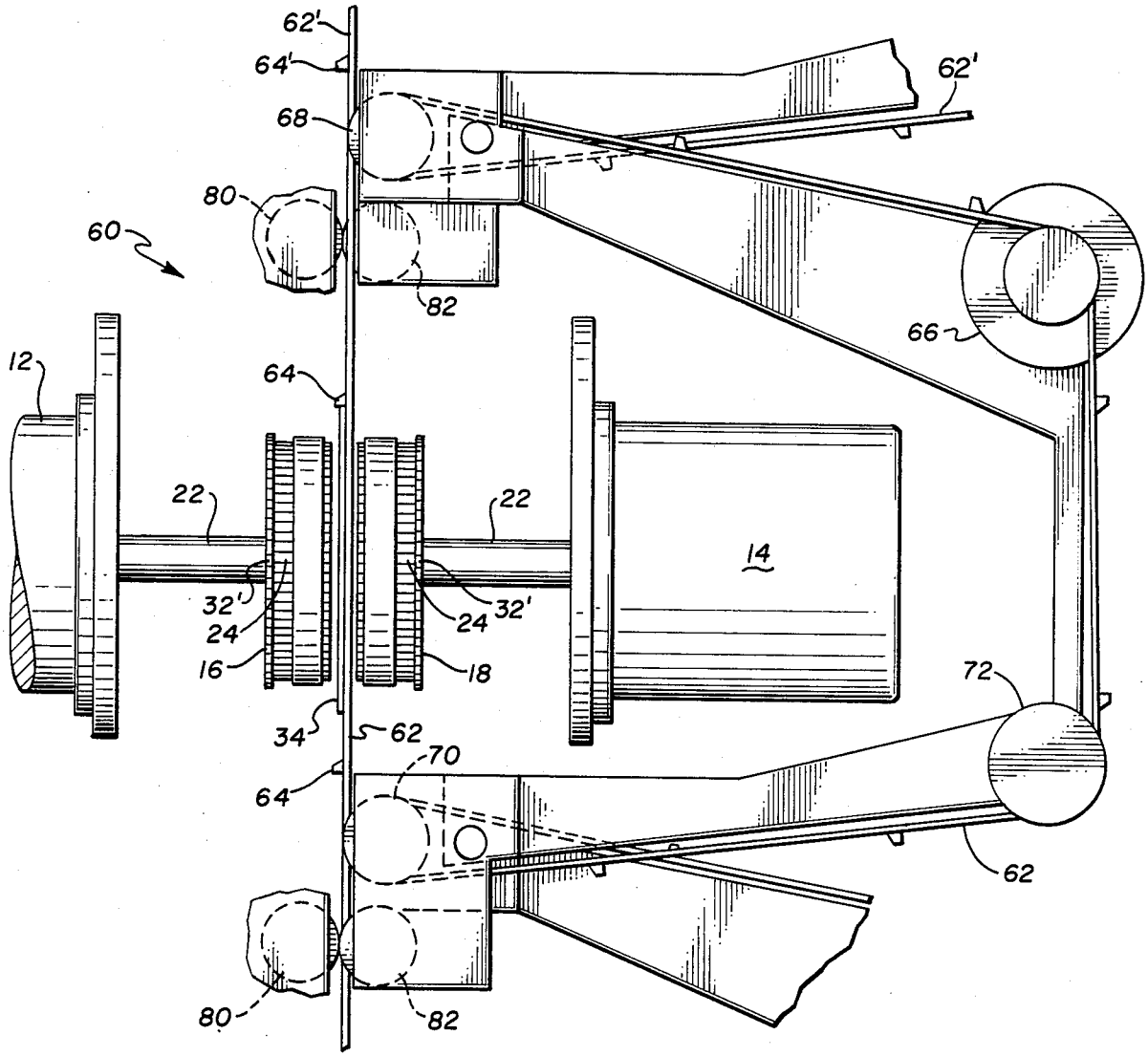
FIG. 3 is a top view of an embossing mechanism and card transport mechanism for a single module of a card embossing machine according to the present invention.
Figure 4D:
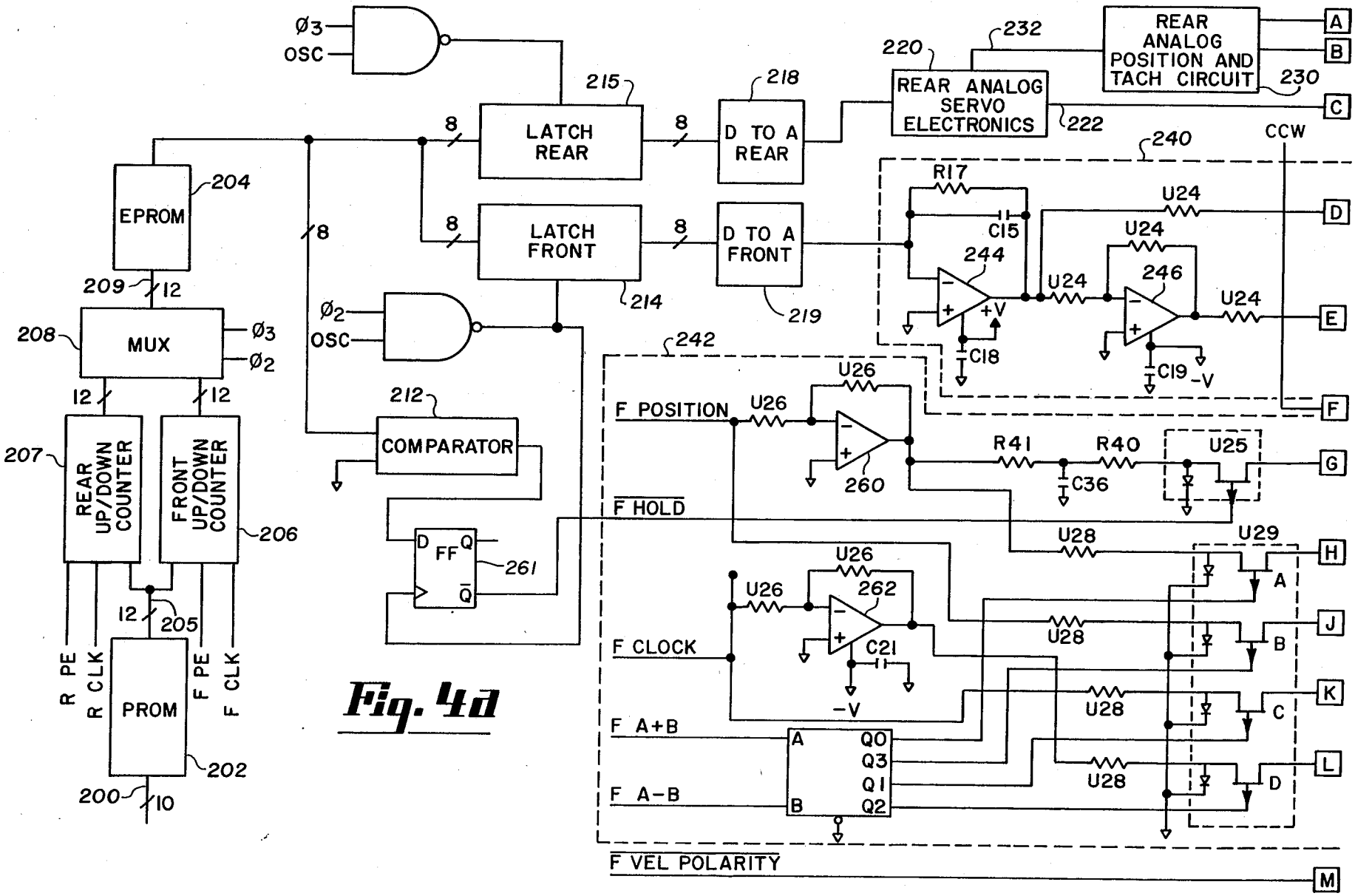
FIGS. 4*a* and 4*b* are a detailed schematic drawing of the electronic circuitry for controlling the printwheel position.
Figure 4B:
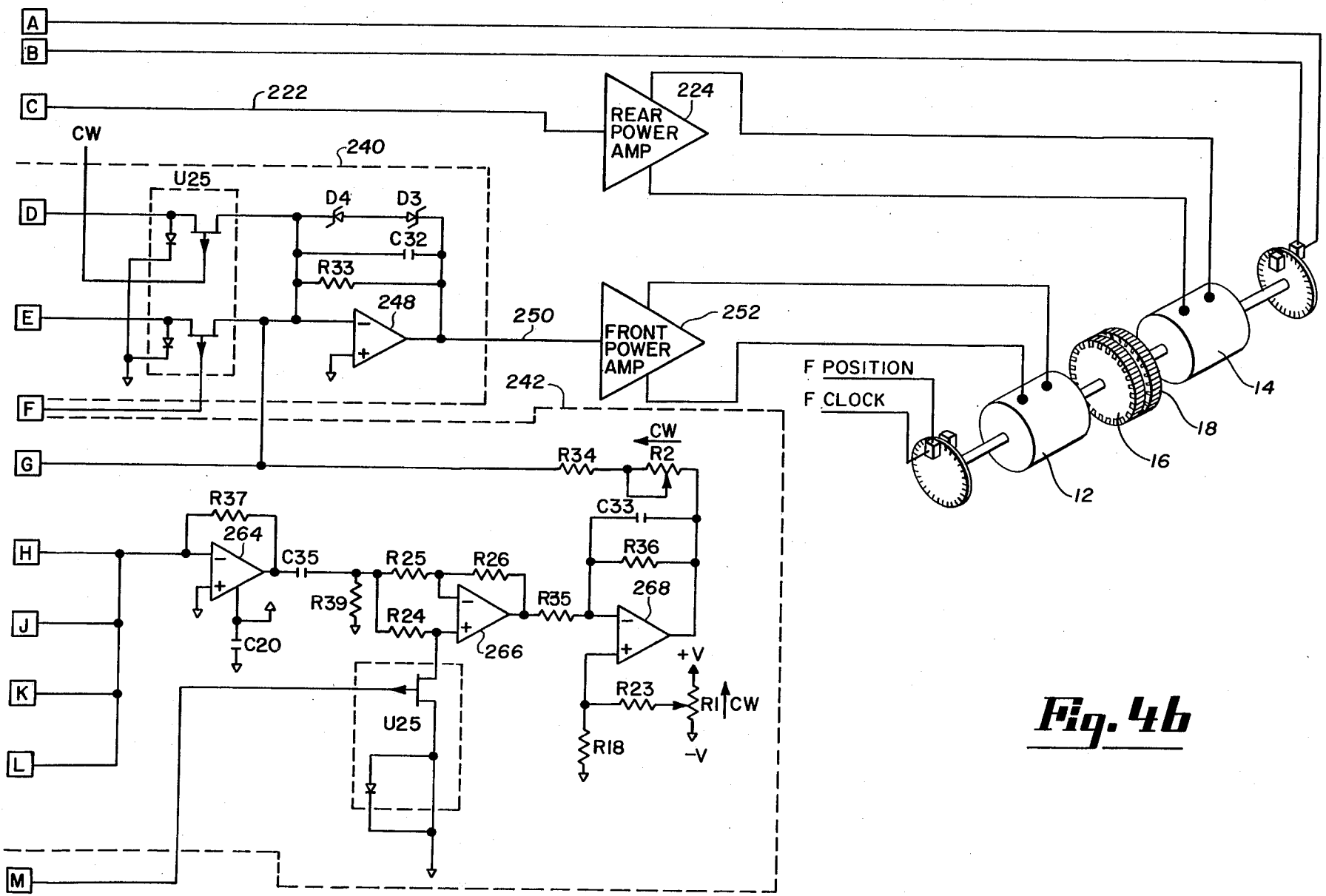

In the time that shaft 48 takes to make a half revolution, it is necessary to reposition printwheels 16 and 18 to align the next print elements at the embossing station and to index the card by one character position. The electronics for controlling the positioning operations of printwheels 16 and 18 is shown in FIGS. 4*a* and 4*b* below and the card indexing mechanism is shown in FIG. 3 below. If, for any reason, the positioning is not complete before the cam reaches the next embossing cycle, a failure signal will be generated to actuate the retractor. When the problem is corrected and the lanyard is released, the interrupter mechanism is returned to its initial position by return springs 303 and 305, and the embossing continues normally.

Card Transfer Mechanism

Turning now to FIG. 3, a single module of an embossing machine according to the present invention is shown. Printwheels 16 and 18 are shown on both sides of a card 34 which is positioned on a transport track 36 not specifically shown in FIG. 3. FIG. 3 also does not include the details of the bail arms and embossing mechanism of FIG. 1. Card 34 is moved to various positions relative to printwheel 16 and 18 by a belt 62 which has a series of projections or spurs 64 projecting outwardly therefrom as belt 62 is moved by motor 66 around pulleys 68, 70 and 72. Belt 62' and projection 64' are a part of the card transfer path which precedes the module shown in FIG. 3 where belt 62 traverses a path driven by motor 66 around pulleys 68, 70 and 72. The control of motor 66 is accomplished by well known servo circuitry not specifically shown. It is necessary for motor 66 to move in steps having an angular displacement sufficient to move belt 62 one character position along the card path in the interval between each compression stroke of the bail arms. The card indexing circuitry is synchronized with the operation of the bail arms 36 and 38 utilizing a suitable position sensor on the bail shaft 48 to sense the position of the shaft to initiate the indexing and printwheel positioning steps after the bail arms open and the print elements 24 are retracted into printwheels 16 and 18.

In prior art card indexing and transport mechanisms, such as the one shown in Drillick U.S. Pat. No. Re. 27,809, which utilize projections on a belt to move a card through a printing path, there is a problem encountered in the transfer of a card from the indexing mechanism for one printing module to the indexing for another printing module. In such situations, the projection or spur 64 is often broken off as the belt turns the corner around the idler pulley because spur 64 catches the trailing edge of card 34 which is moving at the linear speed of the belt, a speed obviously insufficient to allow the card to clear the projection without interference.

In the present machine, a considerable improvement is achieved over prior art systems by providing a set of drive rollers 80 and 82 which are driven at a speed such that a card 34 traveling through their nip will be accelerated to move at a slightly faster speed than the linear speed of belt 62. Thus, when the leading edge of card 34 enters the nip of drive rollers 80, 82, the card is accelerated to a slightly higher speed pulling it away from projection 64 and allowing projection 64 to follow the arcuate path of belt 62 around roller 70 while not in contact with the trailing edge of card 34. Rollers 80 and 82 then drive the card into a position on the next module where a projection on the drive belt for that module will engage the trailing edge of the card and index it through that module for embossing the next line of the card. Use of the accelerating drive roller combination in connection with the drive belts provides considerably longer life for the projections 64 and hence the drive belt. Although it is not specifically shown, the accelerating rollers can be conveniently driven by a belt drive from pulley 70 with the relative diameters of the rollers being selected to give a linear speed to a card in the nip of rollers 80 and 82 slightly higher than the speed of the card as belt 62 is advanced in the normal indexing mode sufficient to pull the trailing edge of card 34 away to clear projection 64 as belt 62 travels over roller 70.

Electronic Motor Control Circuitry

Referring now to FIGS. 4*a* and 4*b*, the operation of the digital and analog electronic circuitry used to drive the printwheels will be described. Computer circuitry not specifically described herein determines the printed information which is to be affixed to a particular card and the positioning of the printing to be affixed.

When a particular character is to be embossed, the computer applies to bus 200 a table address to select a starting address location for the velocity commands stored in the velocity profile table stored in EPROM 204. The selected address in PROM 202 corresponds to the total angular distance to be traversed by the printwheel from its initial position to the position where the selected character is to be embossed. The determination of the angular displacement between the last character to be embossed and the next character to be embossed is performed by the computing circuitry and is delivered on the ten conductor bus 200. Since both the front and rear printwheels must traverse the same angular distance, only a single PROM 202 is needed to store the position command data used to drive both servos. The output of PROM 202 corresponds to the starting address for the velocity profile data stored in EPROM 204.

The output from PROM 202 is delivered by a twelve-conductor bus to front and rear up/down counters 206 and 207, respectively. Front up/down counter 206 also receives a clock signal F CLK which is generated by the encoder and indicative of increments of angular displacement of the front printwheel. The relative phase of the various encoder signals for the front printwheel are shown in FIG. 5. Entirely analogous signals are used for the rear printwheel. An additional signal input to counter 206 is the F PE signal also generated by the position encoder. That signal is used to load the data received on the twelve-conductor bus 205 from PROM 202 into front up/down counter 206.

Similarly, the rear up/down counter 207 receives a rear PE signal and a clock signal R CLK generated by the position encoder associated with the rear printwheel to load the output of PROM 202. Counters 206 and 207 are configured in a countdown mode and deliver their outputs to a multiplexer 208 which is driven by clock signals $\phi 2$ and $\phi 3$ to alternatively select the signal from the front or the rear counter and deliver it to EPROM 204 on a twelve-conductor bus 209. Multiplexer 208 selects between the outputs of the front counter 206 and the rear counter 207 under the control of clock signals $\phi 2$ and $\phi 3$. The phase of the clock signals $\phi 2$ and $\phi 3$ are shifted 180° from each other.

At the beginning of the printwheel positioning sequence when the printwheels are to be moved from a first to a second position, the initial address selected in EPROM 202 is delivered to front and rear up/down counters 206 or 207 and through multiplexer 208 to EPROM 204 to select the first front and rear velocity profile increment from storage for generation of a front and rear initial velocity command to the analog servos. Under the control of signals $\phi 2$ and $\phi 3$, the output multiplexer 208 continuously switches between the contents of front counter 206 and rear counter 207 as to the velocity command address for EPROM 204. Those addresses continuously change as the front and rear up/down counters 206 and 207 are incremented to update them with the current position of the front and rear printwheels. The modified addresses, when delivered to EPROM 204, cause the selection of the previously programmed velocity commands for the wheel drive servos in accordance with the instantaneous position of the printwheels.

In order to minimize the usage of power, the driving sequence of the printwheel from any character position to any other position is always accomplished in a fixed time. The time interval for the sequence is selected to allow the card to be indexed between embossing positions and the embossing bail arms and associated mechanism to be positioned for the next embossing step. Since the system is programmed to take the same amount of time to move between two adjacent characters as to make the maximum length move, the necessity of acceleration at maximum rates is reduced. Considerable power savings are achieved over a system which makes every character changing move in the shortest possible time.

For each velocity profile sequence stored in the EPROM 204, the last velocity command address in the sequence produces an output which is a zero at each bit position. Comparator 212 detects this condition and produces a stop bit on its output line when an output of EPROM 204 reaches an all zero condition. The stop bit which signifies that the wheel has reached its indicated position, is used as discussed more fully below to switch the servo from a velocity mode to a position mode to hold the printwheels in the desired position. The stop bit may also be used in the interrupter mechanism to cause the actuator to decouple the bail arms from the print elements. When the stop bit is not received prior to the embossing cam reaching the compression portion of the cycle.

The velocity commands from EPROM 204 are simultaneously delivered to front and rear latch circuits 214 and 215. Gates 214 and 215 receive further logic signals coordinated with the signals provided to multiplexer 208 to enable their outputs only when EPROM 204 is delivering velocity command information intended for their respective printwheels. Thus, the front latch 214 receives a clock signal which is NANDed from the $\phi 2$ clock signal and the clock signal OSC, while latch 215 is clocked by a signal NANDed from the encoder signal V3 and the clock signal OSC.

Turning now to the rear printwheel control circuitry, the output of the rear latch 215 is converted from a digital to an analog signal by D to A converter 218. The analog rate command is applied to the analog servo electronics 220, which generate an output command on line 222 which drives a rear power amp 224 which, as shown in FIG. 4*b*, drives the rear servo motor 14.

The output of the servo amp is bipolar to allow rotation of the printwheel in either direction to shorten the distance required to be traveled between print elements to minimize the power usage of the servo motor. The feedback signals coming from the transducer associated with the rear servo motor are connected to analog position and tach circuit 230 and produce analog rate and position feedback signals on conductors generally designated 232. The detailed operation of the analog servo electronic circuit 220 and the analog position and tach circuit 230 can be best understood by reference to the more detailed schematic circuitry of the front analog servo electronics enclosed in the dashed line 240 and the front analog position and tach circuit 242.

The circuitry in rear analog servo electronics 220 corresponds to that shown in front analog servo electronics 240. The analog output of the D to A converter 219 is delivered to a signal conditioning amplifier circuit 244 and the output of that amplifier is delivered through an inverting circuit utilizing amplifier 246 and a non-inverting circuit to a pair of FET switches U25, only one of which is enabled at any particular point in time, depending upon whether a clockwise or a counterclockwise command is desired. The logic signals CW and CCW which indicate whether the command is clockwise or counterclockwise is generated by the main computer circuitry.

The selected signal is then applied to a predriver 248 which has appropriate command limiting circuitry using feedback zeners D3 and D4 and provides an output command on conductor 250 which drives the front power amp 252 which provides the power drive for the front servo motor.

Tachometer Circuitry

The rear analog position and tach circuit 230 corresponds to the front analog position and tach circuit 242 which is shown in detail in FIGS. 4*a* and 4*b*. The two signals from the encoder are designated F POSITION and F CLK. Those are both generally triangular signals which, as shown in FIG. 5 are phase shifted 90° from each other. The F HOLD signal is generated from the stop bit output on conductor 214 from comparator 212. The F A+B and F A−B signals are generated circuitry, not shown which converts the position encoder analog signals F CLK and F PE into the FA, FB, FA+B and FA−B commutation signals as shown in FIG. 5. The F POSITION signal is connected through an amplifier 260 and connected through a switch U25 to the input of the predriver 248 when switch U25 is enabled to a conducting condition. That switch is enabled when the stop bit is generated indicating that the printwheel bus reached the selected position. The switch control signal is derived from the Q output of a flipflop of Dual D flipflop module 261 which receives the same clock signal as latch 214. The position feedback using amplifier 260 provides a means for holding the printwheel in the proper position until it is commanded to drive to the next position.

The F POSITION signal is also connected to stage B of a four-stage commutating switch U29. Stage A receives the inverted F POSITION signal from amplifier 260. Stage C receives the F CLOCK signal, while stage D receives the inverted F CLOCK signal which is generated by amplifier 262. The drive signals for U29 are provided by 263, a one of four decoder circuit which sequentially and singly enables stages A, B, C and D of commutation switch U29 and delivers the selected signal to amplifier 264 which has its output differentiated by C35 and R39.

This tachometer circuit arrangement is a substantial improvement over prior art tachometer circuits which utilize separate differentiating circuits for each commutating switch signal and therefore require close matching or balancing of the individual differentiating capacitors used for each of the four signal lines. The differentiated position signal is used as a rate feedback signal which is then passed through an amplifier 266. The switch U25 which connects the non-inverting input of amplifier 266 to ground when enabled receives the F CLK polarity logic signal shown in FIG. 5.

The output from amplifier 266 is amplified by amplifier 268 and passed through resistors R2 and R34 to the input of predriver 248. Thus, the analog position and tach circuits 230 and 242 provide a rate feedback signal from the encoders as the printwheels are slewed to a new position in accordance with the stored velocity profile and are then switched to providing a position feedback signal to hold the printwheels in the desired position during the emboss cycle.

What is claimed is:

1. A document transfer mechanism for transporting a document along a document transfer path, comprising:
   - belt means passing over first and second wheel means mounted adjacent to said document transfer path for aligning a segment of said belt means with the document transfer path;
   - at least one spur means projecting from said belt means for engaging the trailing edge of a document positioned on the document transfer path between the first and second wheel means;
   - drive means for moving said drive belt means and pushing a document from the first wheel means to the second wheel means; and
   - accelerator means driven in synchronism with said drive means for engaging the leading edge of a document approaching the second wheel means and increasing the transport speed of the document relative to said belt means, thereby disengaging said spur means from the trailing edge of said document means prior to said spur means passing over said second wheel means.

2. The invention of claim 1 wherein said accelerator means comprises at least one pair of roller means mounted on both sides of the document transfer path, the nip of said roller means being positioned for engaging the leading edge of said document, said roller means being driven by said drive means.

3. The invention of claim 2 wherein said accelerator roller means is connected by a belt to a third wheel mounted on a shaft upon which said second wheel means is axially mounted.

4. The invention of claim 1 wherein said drive means drives said belt means and said accelerator means in incremental steps.

* * * * *